US009708826B2

(12) United States Patent
Michelon et al.

(10) Patent No.: US 9,708,826 B2
(45) Date of Patent: Jul. 18, 2017

(54) POOL CLEANING APPARATUS WITH ACTIVE EMPTYING AND METHOD FOR CONTROLLING SUCH AN APPARATUS

(71) Applicant: ZODIAC POOL CARE EUROPE, Paris (FR)

(72) Inventors: Thierry Michelon, Toulouse (FR); Louis Favie, Colomiers (FR)

(73) Assignee: ZODIAC POOL CARE EUROPE, Paris (FR)

( * ) Notice: Subject to any disclaimer, the term of this patent is extended or adjusted under 35 U.S.C. 154(b) by 985 days.

(21) Appl. No.: 13/904,048

(22) Filed: May 29, 2013

(65) Prior Publication Data

US 2013/0341284 A1 Dec. 26, 2013

(30) Foreign Application Priority Data

Jun. 22, 2012 (FR) ..... 12 55961

(51) Int. Cl.
*E04H 4/16* (2006.01)

(52) U.S. Cl.
CPC ..... *E04H 4/16* (2013.01); *E04H 4/1654* (2013.01)

(58) Field of Classification Search
CPC ..... E04H 4/16
USPC ..... 210/739, 85
See application file for complete search history.

(56) References Cited

U.S. PATENT DOCUMENTS 5,882,512 A * 3/1999 Denkewicz, Jr. ..... C02F 1/688 137/268
6,886,205 B1 * 5/2005 Pichon ..... E04H 4/1654 15/1.7
8,393,034 B2 * 3/2013 Pichon ..... E04H 4/1654 15/1.7
2011/0020139 A1 * 1/2011 Pichon ..... E04H 4/1654 417/46
2011/0023247 A1 * 2/2011 Pichon ..... E04H 4/1654 15/1.7

(Continued)

FOREIGN PATENT DOCUMENTS

FR 2954381 6/2011
WO 2009081040 7/2009
WO WO2009081040 * 7/2009 ..... E04H 4/16

OTHER PUBLICATIONS

International Search Report and Written Opinion dated Oct. 9, 2013 in Application No. PCT/FR2013/051422.
Preliminary Search Report for FR1255961 dated Feb. 12, 2013.

*Primary Examiner* — Robert Clemente
*Assistant Examiner* — Akash Varma
(74) *Attorney, Agent, or Firm* — Dean W. Russell; Kilpatrick Townsend & Stockton LLP

(57) ABSTRACT

The invention relates to a pool cleaning apparatus and a method for controlling such an apparatus comprising a body, a liquid inlet, a liquid outlet, a drive device, a pumping device, a hydraulic circuit between a liquid inlet and a pumping outlet and via a cleaning device, a monitoring device providing electronic signals which are representative of a state of the apparatus, an electronic signal processing unit receiving and analyzing the signals of the monitoring device and controlling the pumping device, wherein, on detection of a removal event of the body from the liquid, the processing unit stops the pumping device after a predetermined emptying time in order to allow active emptying of the hydraulic circuit.

9 Claims, 5 Drawing Sheets

(56) References Cited

U.S. PATENT DOCUMENTS

| | | | |
|---|---|---|---|
| 2011/0088182 | A1 | 4/2011 | Hui |
| 2011/0197932 | A1 | 8/2011 | Mastio et al. |

* cited by examiner

POOL CLEANING APPARATUS WITH ACTIVE EMPTYING AND METHOD FOR CONTROLLING SUCH AN APPARATUS

CROSS-REFERENCE TO RELATED APPLICATION

This application claims the benefit of and priority to French Patent Application No. 12/55961 filed on Jun. 22, 2012, the contents of which are incorporated herein by reference.

BACKGROUND OF THE INVENTION

The invention relates to a pool cleaning apparatus, in particular a swimming pool cleaning apparatus.

There are known a number of apparatuses which allow a pool to be cleaned, in particular allow the liquid thereof and/or the immersed walls to be cleaned. During operation, these apparatuses are immersed in the liquid of the pool and are therefore at least partially filled by it. This is more generally the case since this type of apparatus comprises a hydraulic circuit in which a portion of the liquid of the pool is circulated in order to clean it, for example, by means of filtration.

Consequently, the weight of the apparatus, once withdrawn from the liquid, is the sum of the weight of the apparatus in the empty state and the weight of the volume of liquid contained in the apparatus. This weight of the apparatus, once withdrawn from the liquid, is therefore generally quite great and in any case greater than the weight of the apparatus in the empty state. It is therefore often the case that a user who has succeeded, when the apparatus is used for the first time, in carrying it to the pool to be cleaned is subsequently no longer capable of removing this apparatus from the pool owing to the additional weight brought about by the presence of a volume of residual liquid in the apparatus. These apparatuses must be removed from the pool on a regular basis, in particular from a swimming pool in order to be able to bathe therein, to carry out maintenance of the apparatus or to clean the apparatus.

There are known more specifically apparatuses as described in WO2009/081040 and US 2011/0088182 in which the water contained in the apparatus at the time it is removed from the pool is discharged in a passive manner, by means of gravitational force, via an opening of the shell, an operating handle being arranged opposite said opening.

In such apparatuses, however, the discharge of the water is slow, and even slower if the discharge opening in the shell is narrow. The user removing the apparatus from the pool must therefore lift the weight of the apparatus and the water which it contains for a significant length of time, which is neither ergonomic, nor pleasant, and in any case not acceptable for weak persons such as children or elderly persons. A significant emptying time is all the more unacceptable since the user is generally in a position which is difficult to maintain with a great load in his hand: being at the edge of the pool, he generally holds the apparatus above the pool so that the discharged water returns into the pool.

SUMMARY OF THE INVENTION

An object of the invention is therefore to overcome these disadvantages.

An object of the invention is to provide a pool cleaning apparatus whose emptying time is reduced.

An object of the invention is also to provide such an apparatus which is not more complex or costly in order to reduce the emptying time, and in particular which does not include a component or specific device in order to reduce the emptying time.

The invention can be used for any swimming pool cleaning apparatus of the above-mentioned type which may in particular have a drive system and pumping system of the electric, hydraulic or mixed type.

However, an object of the invention is more specifically to provide such an apparatus which is of the self-propelling type and which has (an) on-board electric driving and pumping motor(s).

An object of the invention is also to provide a method for controlling a pool cleaning apparatus which allows the emptying time to be reduced.

The invention therefore relates to a pool cleaning apparatus comprising:

- a body which can be immersed in a liquid of the pool, having:
  - at least one liquid inlet into the body,
  - at least one liquid outlet out of the body,
- a device for driving the body in the pool,
- a liquid pumping device,
- a hydraulic circuit which is adapted to be able to ensure, when said pumping device is active, a circulation of liquid between at least one liquid inlet into the body and at least one liquid outlet, called the pumping outlet, out of the body via at least one cleaning device,
- a monitoring device which is adapted to be able to provide electronic monitoring signals,
- an electronic signal processing unit which is adapted to be able to:
  - receive and analyze the signals supplied by the monitoring device,
  - control the liquid pumping device in accordance with said signals supplied by the monitoring device, characterized in that:

- the monitoring device is adapted to be able to provide at least one electronic monitoring signal, called a removal signal, which is representative of the body being removed from the liquid,
- the processing unit is adapted for:
  - being able to detect a removal signal from the signals supplied by the monitoring device,
  - on detection of a removal signal, maintaining the pumping device in an active state for a non-zero predetermined period of time, called the emptying time, in order to allow at least partial active emptying of the hydraulic circuit for this emptying time after the body has been removed from the liquid,
  - stopping the pumping device after the emptying time.

The pumping device therefore remains operational after the body has been removed from the liquid so that it empties the hydraulic circuit in an active manner. The invention thus allows the emptying of the hydraulic circuit of the apparatus to be accelerated, which is particularly advantageous when the hydraulic circuit occupies a significant volume of the body of the device.

An on-board cleaning device of the apparatus according to the invention may be of different types: for example, a filtration device and/or a chlorination device, etc.

In the same manner, a monitoring device according to the invention may be of different types: for example, a manometer, a camera installed outside the pool or a camera on-board the apparatus, an accelerometer, an ammeter which measures the electrical power supply of the pumping device, a microphone, etc.

The processing unit is adapted to be able to control the liquid pumping device, that is to say that it is adapted to be able to at least start it and stop it, and optionally to modulate the operating power thereof in order to be able to modulate the liquid flow rate in the hydraulic circuit.

Advantageously and according to the invention, the electronic signals provided by the monitoring device are digital signals and the signal processing unit is a digital processing unit for digital signals, for example, of the microcontroller or microprocessor type. However, there is nothing to prevent a device according to the invention from providing analogue electronic circuits which perform the same monitoring functions of analysis, detection and control.

Advantageously and according to the invention, the processing unit recognizes a signal profile, called a removal signal, which corresponds to an event, called a removal event, corresponding to the body being removed from the liquid.

To this end, the processing unit advantageously comprises a memory which comprises data, called removal data, which are representative of a removal signal profile which corresponds to a removal event, the signals provided by the monitoring device being continuously compared by the processing unit to said removal data stored in the memory.

The processing unit further comprises a timer which allows the emptying time to be defined. Such a timer may be produced in different manners, for example, said memory may comprise data which are representative of a value of the emptying time.

Advantageously and according to the invention, the pumping device and the emptying time are adapted so that at least 50% of the hydraulic circuit is emptied when the pumping device is stopped. In particular, the pumping device and the emptying time are adapted so that at least 80% of the hydraulic circuit is emptied when the pumping device is stopped. More specifically, the pumping device and the emptying time are adapted so that at least 90%—and more advantageously more than 95%—of the hydraulic circuit is emptied when the pumping device is stopped.

The emptying time is in particular adapted in accordance with the pumping device, in particular in accordance with the power (or total manometric height) of the pumping device. This is because, in accordance with the power of the pumping device, the liquid flow rate differs and therefore the emptying time required to empty at least 50% of the hydraulic circuit may vary.

More specifically, advantageously and according to the invention, the emptying time is adapted so that all of the hydraulic circuit located upstream of the pumping device is emptied when the pumping devices is stopped.

Advantageously and according to the invention, the emptying time is between 2 seconds and 30 seconds.

Advantageously and according to the invention, the emptying time is adapted so that, before the pumping device is stopped, it pumps air for a predetermined non-zero period of time, called the draining time.

Advantageously and according to the invention, the draining time is between 1 second and 10 seconds.

The draining time is included in the emptying time. The emptying time extends from the detection of the removal of the body from the liquid until the pumping device has stopped. The draining time extends from the time at which the pumping device begins to pump air until the pumping device has stopped. The detection of the air pumping by the pumping device may be carried out in different manners: measuring the rotation speed of a rotating pumping element of the pumping device, measuring the electrical intensity supplied to a pumping device which is supplied with electrical power, detecting air at a location of the hydraulic circuit, etc.

The draining time is more specifically between 2 seconds and 5 seconds.

Indeed, the inventors have unexpectedly found that, leaving the pumping device in an operational state for a relatively short draining time when the body is removed from the liquid does not damage said pumping device.

During this draining time, the pumping device pumps air which pushes the liquid remaining downstream of the pumping device towards a pumping outlet. The inventors have surprisingly found that, although the pumping device is provided in order to pump a liquid (having a much higher density than air), it could, under given conditions, create excess pressure in the air which is sufficient to discharge the liquid remaining downstream of the pumping device.

Advantageously and according to the invention, the pumping device is arranged in a downstream half of the hydraulic circuit, which in particular allows the draining time to be limited relative to the emptying time.

More specifically, the pumping device is advantageously arranged at least at more than 35% of the distance, through the hydraulic circuit, between each liquid inlet and a pumping outlet. In particular, the pumping device is advantageously arranged at least at more than 80% of the distance, through the hydraulic circuit, between each liquid inlet and a pumping outlet in the circulation direction of the liquid. More specifically, the pumping device is advantageously arranged between 90% and 100% of the distance, through the hydraulic circuit, between each liquid inlet and a pumping outlet.

Furthermore, an apparatus according to the invention is also characterized in that it further comprises an operating member for the body:

- which is adapted to allow a user to carry it manually in order to immerse it in the liquid or to remove it from the liquid,
- which is connected to the body in such a manner that, when the body is suspended via this operating member, the body tilts spontaneously under the action of gravitational force into an emptying position in which each pumping outlet is a low point of said hydraulic circuit.

The operating member may be fixed or advantageously articulated, for example, in a pivoting manner, so that the member remains fixed in the hand of a user during the tilting of the body.

More specifically, the operating member is advantageously arranged on the body so that the direction of the lifting force of the body applied by a user to the operating member does not intersect with the centre of gravity of the body when the body of the apparatus is recovered from the water by the user so as to obtain a tilting and a lifting force of the body applied by a user whose direction tends to be orientated towards the centre of gravity of the body of the apparatus during the tilting.

This position of the operating member allows an air front (circulating in a downstream direction in the hydraulic circuit during its emptying action) to be maintained to the rear of the liquid still contained in the hydraulic circuit in order to prevent any draining of the pumping device whilst liquid is still contained in the hydraulic circuit upstream of said pumping device.

In particular the downstream half of the hydraulic circuit in which the pumping device is located is below the remainder of the hydraulic circuit when the body is in an emptying position, so that the water contained in the hydraulic circuit is moved by means of gravitational force in the region of the pumping device, in order to prevent any draining of the pumping device before the hydraulic circuit has been completely emptied.

The pumping device is advantageously arranged in the hydraulic circuit so that, when the body of the apparatus is in an emptying position, the pumping device is just above a pumping outlet, in particular opposite this pumping outlet.

A position of the operating member which allows the pumping outlet to be a low point of the hydraulic circuit is particularly advantageous when the hydraulic circuit has at least one significant cross-section portion, for example, a filtration chamber of significant volume.

However, the operating member may be arranged differently, in particular when the hydraulic circuit does not have a portion which could form a pocket of water remaining in the hydraulic circuit after the draining time (for example, a siphon-like portion having a particularly large cross-section).

Furthermore, advantageously and according to the invention, the monitoring member comprises an accelerometer device, which is fixedly joined to the body and which is adapted to provide signals which are representative of instantaneous measurements of an acceleration in at least one fixed direction relative to the body.

Advantageously and according to the invention, the accelerometer device is adapted to supply instantaneous measurements of three components of the acceleration of earth gravitational force in three directions which are fixed relative to the body and which are orthogonal in pairs. More specifically, the accelerometer device is advantageously a three-axis accelerometer.

Such an accelerometer device allows the removal of the apparatus from the liquid to be detected, in particular the time at which the apparatus passes the water line of the pool. Indeed, such an accelerometer device allow the detection of the time at which the apparatus is pulled upwards by a user, and more specifically, the time at which the apparatus tilts in order to be placed in the emptying position.

Advantageously, the processing unit comprises a memory in which there is recorded at least one signal of the removal type which is representative of an acceleration along at least one axis—advantageously along three axes—which is/are fixed relative to the body during a removal event. The processing unit continuously compares the signals provided by the accelerometer device with the signal(s) of the removal type recorded in the memory. The signal(s) of the removal type which is/are representative of a removal event may depend on the type of apparatus, for example, the shape of the body, the position of the operating member, the position of the accelerometer device, etc.

Each signal of the removal type representative of a removal event may be obtained by means of experimentation or calculation, and may be recorded in said memory by means of learning or recording during production.

Advantageously and according to the invention, said pumping device comprises at least one electric pumping motor which has a rotary drive shaft which is coupled to at least one pumping propeller which is interposed in said hydraulic circuit in order to generate at that location a flow of liquid between each liquid inlet and each pumping outlet.

Advantageously and according to the invention, the electric motor and the propeller form an axial rotary pump.

The processing unit is adapted to be able to provide control signals of the electric motor of the pumping device in accordance with a predetermined operating mode in accordance with signals supplied by the monitoring device.

Furthermore, advantageously and according to the invention, the monitoring member comprises an ammeter which is adapted to provide signals which are representative of measurements of the intensity of the electrical power supply of the electric pumping motor.

An ammeter which is connected to the electrical power supply of the pumping device allows the removal of the apparatus from the liquid to be detected with a delay. An ammeter allows the detection of the time at which the air front circulating in the hydraulic circuit during the emptying of the apparatus approaches or reaches the pumping device. Indeed, the resistance provided by the liquid with respect to the pumping device is less at this time and the electrical intensity consumed by the pumping device decreases.

The ammeter in particular allows the detection of the draining of the pumping device from which the draining time begins.

The removal event may therefore be the passing of a water line and the recovery by a user when the monitoring device comprises an accelerometer device, and/or the draining of the pumping device when the monitoring device comprises an ammeter which is connected to the electrical power supply of said pumping device.

However, there is nothing to prevent a monitoring device comprising both an accelerometer device and an ammeter from being provided on the electrical power supply of the pumping device. The processing unit is then adapted to initiate a first timing operation which corresponds to the emptying time on detection of a first removal event (recovery by a user) by the accelerometer device or by the ammeter, and to initiate a second timing operation which corresponds to the draining time on detection of a second removal event (draining of the pumping device) by the ammeter. The processing unit is also adapted to stop the pumping device at the expiry of one, the other, or the two emptying and draining times, respectively.

An apparatus according to the invention may be provided to move to any location in the pool. In a pool, however, it is generally desirable to clean the immersed surfaces (in particular the base) on which organisms develop and debris accumulate.

For this reason, advantageously and according to the invention, the drive device comprises members for driving and guiding the body over an immersed surface of the pool.

In particular, the drive device according to the invention is advantageously adapted to be able to move the body over the immersed surface at least in one advance direction and in one main advance direction. To this end, the drive device comprises at least one electric drive motor for at least one drive member, in particular a rolling member selected, for example, from the wheels, the rollers, the tracks, etc.

Advantageously and according to the invention, at least one drive member is also a member for guiding the body relative to the immersed surface.

Advantageously and according to the invention, the processing unit is adapted to be able to provide control signals for each drive motor.

The invention also extends to a method for controlling a pool cleaning apparatus according to the invention. It therefore relates to a method for controlling a pool cleaning apparatus, this apparatus comprising:

a body which can be immersed in a liquid of the pool, having:

at least one liquid inlet into the body, at least one liquid outlet out of the body, a device for driving the body in the pool, a liquid pumping device, a hydraulic circuit which is adapted to be able to ensure, when said pumping device is active, a circulation of liquid between at least one liquid inlet into the body and at least one liquid outlet, called the pumping outlet, out of the body via at least one cleaning device, a monitoring device which is adapted to be able to provide electronic monitoring signals, an electronic signal processing unit which is adapted to be able to:

receive and analyze the signals supplied by the monitoring device, control the liquid pumping device in accordance with said signals supplied by the monitoring device, the method being characterized in that:

the monitoring device provides at least one electronic monitoring signal, called a removal signal, when the body is removed from the liquid, on detection of a removal signal, the processing unit maintains the pumping device in an active state for a non-zero predetermined period of time, called the emptying time, in order to allow at least partial active emptying of the hydraulic circuit for this emptying time after the body has been removed from the liquid, the processing unit stops the pumping device after the emptying time.

In a method according to the invention, the emptying time is advantageously selected so that at least 50% of the hydraulic circuit is emptied when the pumping device is stopped.

More specifically, advantageously and according to the invention, an emptying time of between 2 seconds and 30 seconds is selected, in particular less than 20 seconds, and more particularly between 5 and 15 seconds, for example, in the order of ten seconds.

Advantageously, the emptying time is selected so that, before the pumping device is stopped, it pumps air for a predetermined non-zero period of time, called the draining time.

A draining time is advantageously selected between 1 second and 10 seconds, in particular between 1 and 5 seconds.

The method according to the invention is implemented in an apparatus according to the invention, in particular by the processing unit thereof. The invention also extends to an apparatus which is adapted to be able to be controlled in accordance with a method according to the invention.

The invention also relates to a pool cleaning apparatus and a method for controlling such an apparatus, characterized in combination by all or some of the characteristics mentioned above or below.

BRIEF DESCRIPTION OF THE DRAWINGS

Other objectives, features and advantages of the invention will be appreciated from a reading of the following description, given purely by way of non-limiting example and with reference to the appended Figures, in which.

DETAILED DESCRIPTION OF THE DRAWINGS

Figure 1:
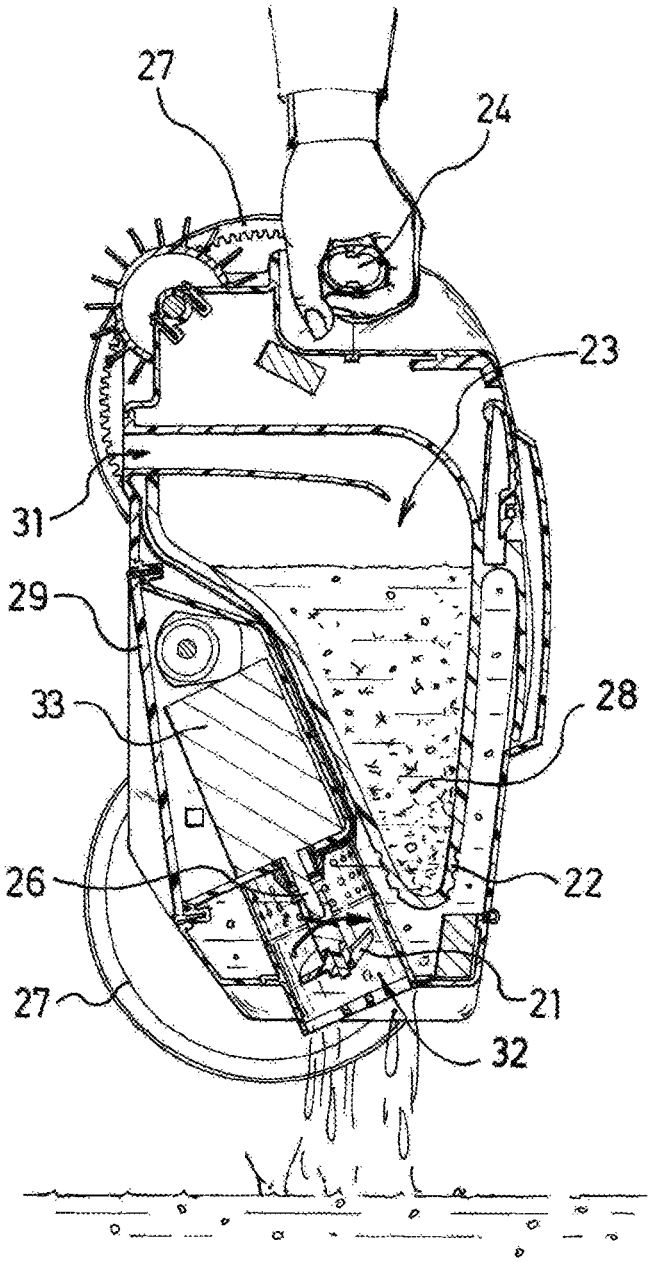
FIG. 1 is a schematic longitudinal cross-section of a pool cleaning apparatus in an emptying position, during the emptying, in accordance with a first embodiment according to the invention.

An apparatus according to the invention as illustrated in FIG. 1 is particularly adapted for cleaning swimming pools, in particular for cleaning the walls of swimming pools.

The apparatus advantageously has a body 29 which can be submerged in the water of a swimming pool. Said body 29 has a device for driving this body 29 over the immersed surface in a main advance direction, called a longitudinal direction, comprising at least one axle which has non-directional wheels 27 and which extends in a direction perpendicular to a longitudinal direction of the body 29. The drive device comprises in particular members for driving and guiding the body on a swimming pool wall which are wheels 27. At least a portion of the wheels 27 is advantageously driven, for example, by one (or a plurality of) electric motor(s) in order to move the body 29 of the apparatus over a wall of the pool.

Said body 29 is a hollow member which is formed principally by a generally concave housing which delimits a main chamber, this housing having openings which are provided at the base of the housing and remote from the base of the housing, respectively, these openings forming a liquid inlet 31 into the body 29 and a liquid outlet, called the pumping outlet 32, out of the body 29.

The apparatus also comprises a hydraulic circuit 23 which extends into the body 29 and which ensures a circulation of water between the water inlet 31 and the outlet into the body 29. More specifically, the body contains a pumping device comprising:

a pump motor 33 which is mounted so as to be fixed in the body 29 and which moves a primary shaft 26 in terms of rotation, and a propeller 21 which is mounted on the primary shaft 26.

The pumping device ensures a circulation of water in the hydraulic circuit 23 of the inlet 31 towards the pumping outlet 32 and through a cleaning device which is interposed in the hydraulic circuit so that the notions of upstream and downstream are set out with respect to the inlet 31 and the pumping outlet 32, respectively, the inlet 31 being the most upstream location of the hydraulic circuit and the pumping outlet 32 being the most downstream location.

In the embodiment illustrated, the cleaning device comprises a chamber 28 and a filter 22 through which the water passes but not debris to be filtered. Such a cleaning device may comprise numerous other elements: UV irradiation elements, chlorination elements, etc.

Furthermore, the body 29 comprises an operating member which is a handle 24. This latter is arranged at a longitudinal end of the body 29.

The handle 24 may be fixed or articulated. It can, for example, advantageously be pivoted about an axis transverse with respect to the body so that the member remains fixed in the hand of a user during the tilting of the body.

More specifically, the operating member is advantageously arranged on the body remote from the centre of gravity of the body so that the direction of the lifting force of the body applied by a user to the operating member does not intersect with the centre of gravity of the body at the time when the body of the apparatus is recovered from the water by the user, in particular when the apparatus is substantially horizontal.

In the first embodiment of an apparatus according to the invention, the pumping outlet 32 is provided at a longitudinal end of the body opposite the handle 24. In this manner, when a user grips the body 29 of the apparatus by the handle 24 arranged at the front of the body, it is placed in a vertical position, called an emptying position, as illustrated in FIG. 1, under the effect of gravitational force. The pumping outlet 32 which is arranged at the rear of the body is therefore open in a downward direction in the emptying position of the body in order to facilitate the emptying of the hydraulic circuit 23. In this first particularly advantageous embodiment, the pumping outlet 32 is therefore advantageously a low point of the hydraulic circuit 23 when the body is in an emptying position.

In this manner, the water contained in the hydraulic circuit 23 when the body is removed from the water is entirely above the pumping outlet 32. As illustrated in FIG. 1, the hydraulic circuit is being emptied and, in accordance with the invention, the pumping device is operational, so that it accelerates the discharge of the water which would only occur much more slowly under the effect of gravitational force alone and which would not be carried out completely if the hydraulic circuit had a siphon-like shape in the emptying position.

In this manner, an apparatus and a method according to the invention are particularly advantageous in the case of an apparatus of great volume, in particular in an apparatus whose inner volume of the hydraulic circuit is great. Yet, a great hydraulic circuit volume allows the filtration to be improved, clogging of the filters to be reduced, etc.

Indeed, the weight represented by the water contained in the hydraulic circuit when the apparatus is removed from the water is even greater as the volume of the hydraulic circuit becomes greater. Maintaining the pumping device 33, 21 in an operational state in accordance with the invention therefore allows the emptying of the water contained in the hydraulic circuit to be significantly accelerated and complete emptying to be ensured.

The weight of the apparatus when removed from the pool is therefore supported by the user for a shorter period of time, and the weight of the body during and after the emptying is lower. In particular an apparatus as illustrated in FIG. 1 weighs approximately 12 kg and it is estimated that the inner volume of the hydraulic circuit is approximately 8 l, that is, a total weight when removed from the water of approximately 20 kg.

In an apparatus of the prior art as described by WO 2009/081040, of equivalent volume, the pumping device 33, 21 is stopped before or as soon as it is removed from the water: the duration of emptying is approximately 9 seconds with a maximum lifted weight of approximately 25 kg.

In an apparatus according to the invention, however, the pumping device 33, 21 is maintained in an operational state for the entire duration of the emptying operation, and the emptying time is reduced to approximately 6 seconds with a maximum lifted weight of approximately 21 kg.

Figure 7:
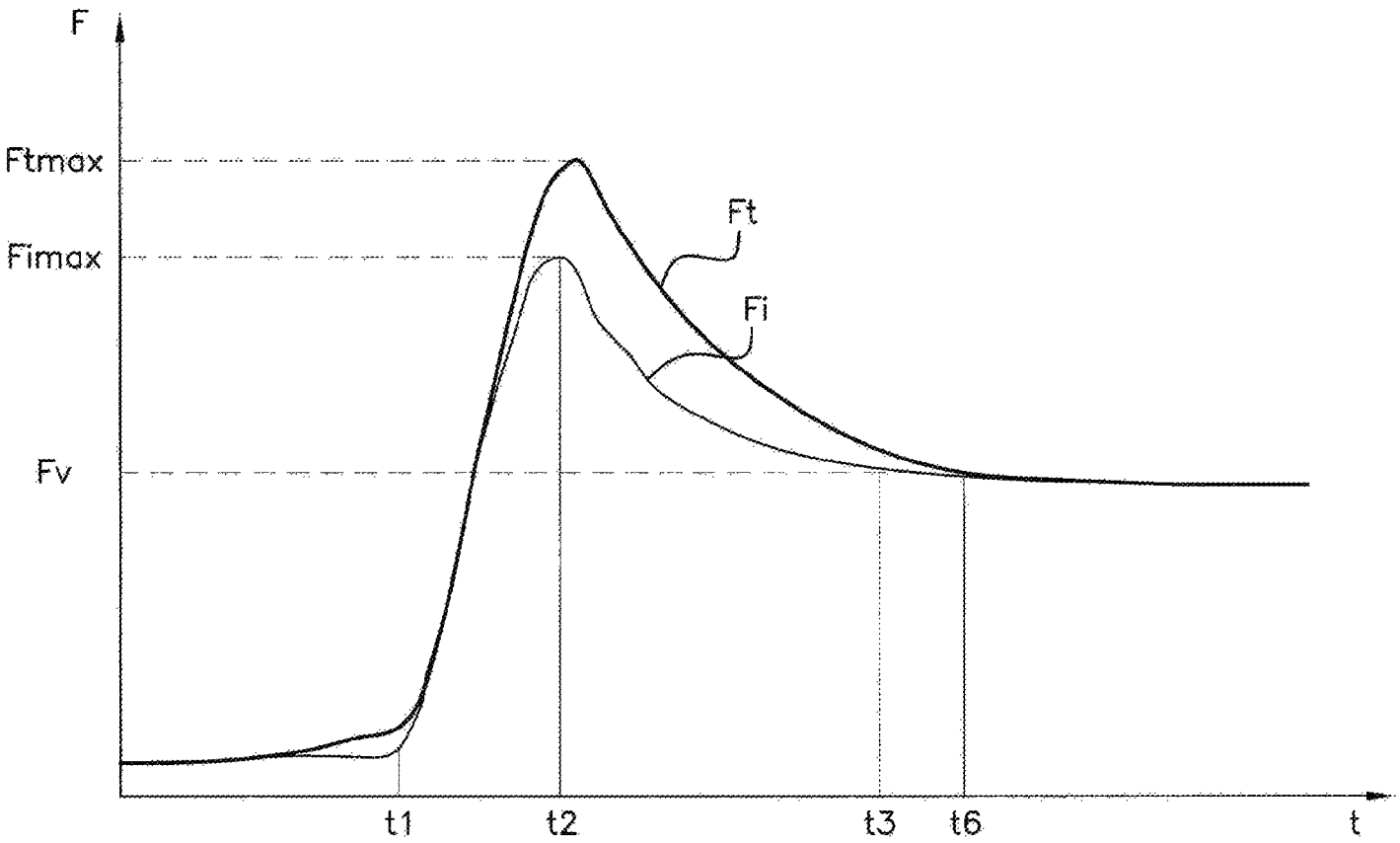
FIG. 7 is a schematic illustration of the vertical effort applied by a user to remove a body of an apparatus from the water of a pool, a body of a sample apparatus and a body of an apparatus according to the invention, respectively, using a method according to the invention.

The force F applied by a user during the time (t) in order to remove the body from the water—which corresponds to the total weight of the body of the apparatus—is illustrated in FIG. 7. The curve Ft is a sample curve which represents the force applied by a user in order to remove the body of an apparatus of the prior art as described by WO 2009/081040 from the water. The curve Fi represents the force applied by a user in order to remove the body of an apparatus which is equivalent but which is in accordance with the invention and using a method according to the invention during and after it has been removed from the water.

At the time t1, the user begins to remove the body of the cleaning apparatus from the water, and the perceived weight increases rapidly as the body is removed from the water since the user loses the advantage of the buoyancy. The body begins to empty as soon as at least one water inlet is out of the water, and the body of the apparatus according to the invention empties more rapidly than that of the sample apparatus.

For this reason, at the time t2, the apparatus is completely outside the pool and the maximum force Ftmax applied by a user to the sample apparatus (curve Ft) is approximately 20% greater than the maximum force Fimax applied by a user to the apparatus in accordance with the invention (curve Fi).

At the time t3, the hydraulic circuit of the apparatus according to the invention is almost completely empty and the propeller of the pumping device is drained. However, in order to completely terminate the emptying of the hydraulic circuit, the pumping device is maintained in an operational state for approximately another 2 seconds, until the time t6 at which it is stopped.

It will be appreciated that the weight of the apparatus in the empty state corresponding to an effort Fv of the user representative of the weight of the body of the apparatus empty of any water is reached far sooner with an apparatus according to the invention than with the sample apparatus.

Furthermore, the total weight carried by the user for the period of time (t2-t3) passing between the complete removal of the apparatus from the water and the complete emptying of the apparatus is, at any time, approximately 20% less with an apparatus according to the invention than compared with a sample apparatus.

If the detection of a removal event of the body 29 from the water is detected as soon as said removal event has occurred, the emptying time may be selected to be less than 15 seconds, in particular advantageously less than or equal to 10 seconds.

Figure 2:
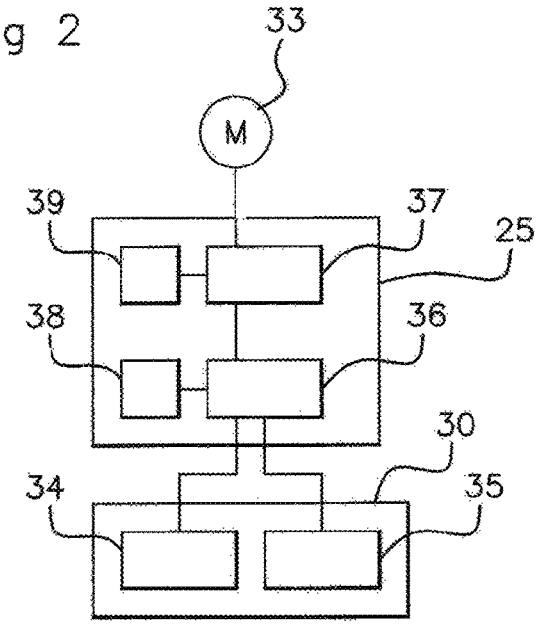
FIG. 2 is a synoptic functional diagram of the on-board electronic system of a pool cleaning apparatus according to the invention, for example, as illustrated in FIG. 1, in particular the electronic elements required for implementing a method according to the invention.

Furthermore, the body 29 of the embodiment illustrated in FIG. 1 advantageously comprises an on-board monitoring device 30 and processing unit 25. These latter are illustrated schematically in FIG. 2.

Figure 6:
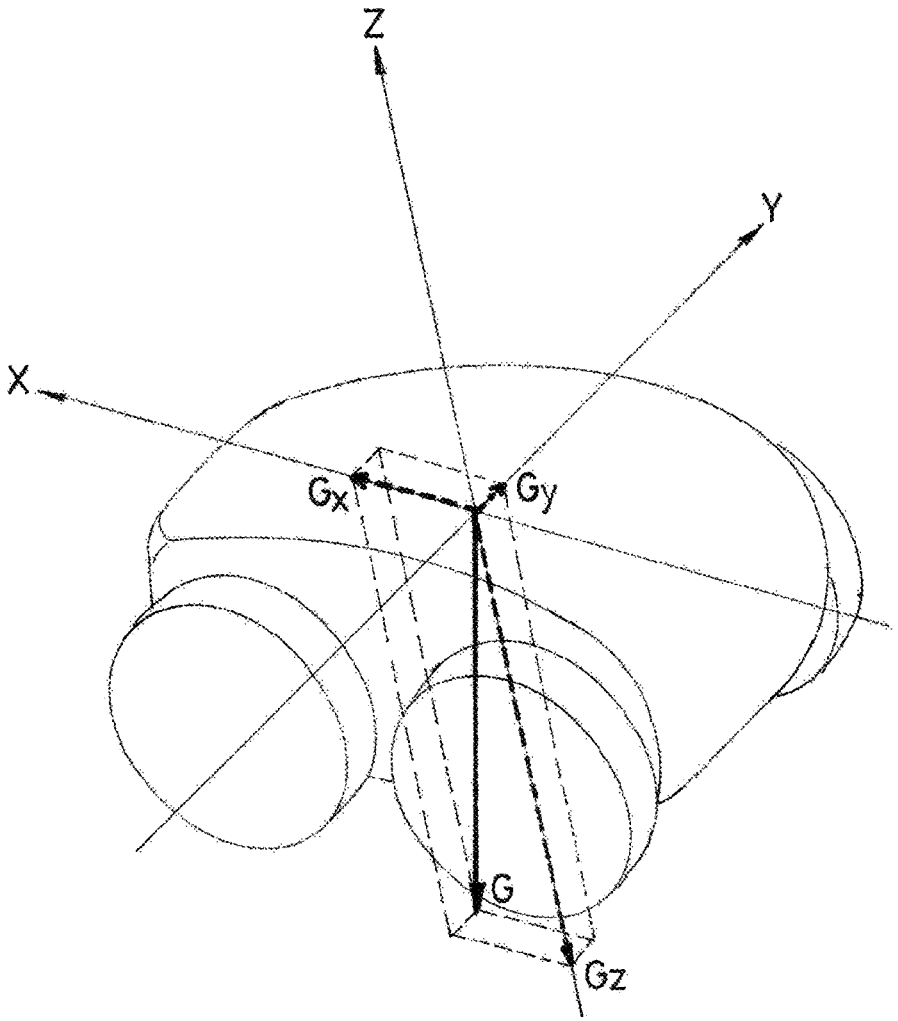
FIG. 6 is a schematic illustration of a reference system having three orthogonal axes corresponding to the three measurement axes of the components of gravitational acceleration supplied by an accelerometer which is fixedly joined to an apparatus according to the invention illustrated in any orientation for the purposes of illustration.

The monitoring device 30 comprises an accelerometer 35, in particular a three-axis accelerometer which is mounted so as to be fixed in position and fixedly joined to the body 29 of the apparatus. This accelerometer 35 is a three-axis accelerometer which is adapted to provide measurements of the components Gx, Gy, Gz of the acceleration of the gravitational force along three orthogonal axes, longitudinal X, transverse Y and vertical Z, which are fixed relative to the accelerometer 35, and therefore relative to the body 29 (FIG. 6). An accelerometer 35 according to the invention may be of any known type, in particular an analogue output type integrated circuit or digital output type integrated circuit. The fixing of the accelerometer to the body 29 of the apparatus may be carried out with adhesive means, screw/nut type means, rivet or other equivalent means.

The output of this accelerometer is electrically connected to the processing unit 25 which may thus receive and process the measurements provided by this accelerometer 35.

The monitoring device 30 further comprises an ammeter 34 which measures the intensity I of the electrical power supply of the motor 33 of the pumping device. The ammeter 34 according to the invention may be of any known type, in particular an integrated circuit of the analogue output type or digital output type. The output of this ammeter 34 is electrically connected to the processing unit 25 which may thus receive and process the measurements provided by this ammeter.

Figure 3:
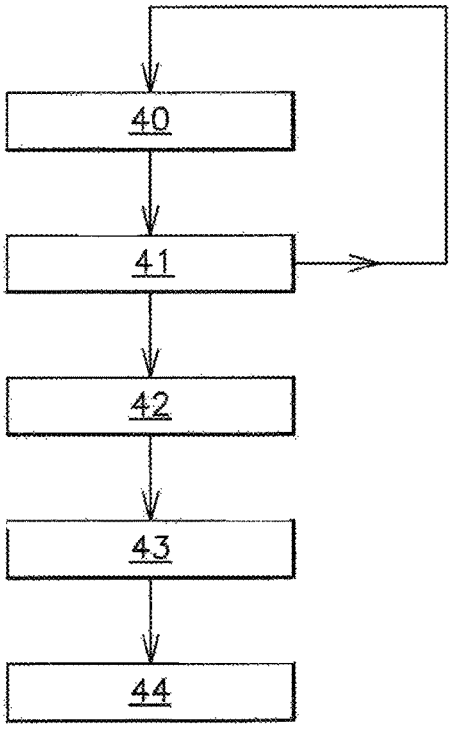
FIG. 3 is a synoptic diagram of an embodiment of the method for controlling a pool cleaning apparatus according to the invention, for example, as illustrated in FIG. 1.

The processing unit 25 is adapted to be able to implement a method according to the invention, for controlling a cleaning apparatus according to the invention. To this end, the processing unit 25 comprises a module 36 for detecting events and a module 37 for controlling motors of the apparatus. Such a method is illustrated schematically in FIG. 3.

In a monitoring step 40, the event detection module 36 continuously receives the signal transmitted by the accelerometer 34 corresponding to the measurement of electrical intensity consumed by the pump 33, and the three signals transmitted by the accelerometer 35 corresponding to the instantaneous measurements of the amplitude of the three components Gx, Gy, Gz of the acceleration of the gravitational force in accordance with the three orthogonal axes X, Y and Z.

In a second detection step 41 which is also carried out continuously, the event detection module 36 records these three components Gx, Gy, Gz of the acceleration of the gravitational force over time and analyses their variations. It carries out tests (for example, via an analogue circuit which is triggered if a threshold value is exceeded or via a digital circuit with graduation) in order to determine whether or not these variations correspond to predetermined events. More specifically, said module 36 compares the values of the three components Gx, Gy and Gz with predetermined values recorded in a memory 38.

The event detection module 36 could alternatively or in combination be adapted to be able to compare the development of each of the values Gx, Gy and Gz over time with one (or more) curve(s) of the type recorded in a memory 38. To this end, the event detection module 36 may implement artificial intelligence processes such as neuron networks.

In this detection step 41, the event detection module 36 also analyses the variations of the intensity I of the power supply of the pump and compares it with values recorded in a memory 38, in particular with a threshold value Is which is characteristic of a lowering of the water resistance corresponding to a removal of the body 29 from the pool.

As long as no predetermined event, in particular as long as no removal event, has been detected by the event detection module 36, the steps 40, 41 for monitoring and detection are continued.

At step 42 initiated on detection of a removal event by the event detection module 36, this latter sends to the control module 37 a signal identifying this removal event.

At the subsequent step 43, the control module 37 initiates a timer 39 which measures a predetermined period of time, in particular a period of time called an emptying time. When this time has elapsed, the step 44 is begun.

At step 44, the control module 37 develops control signals of the electric pumping motor 33, in particular stop signals of said motor 33.

Furthermore, a second process may be carried out in parallel starting from the detection of a removal event in order to detect a draining event of the pumping device 33, 21. In this manner, the event detection module 36 may be adapted to be able to detect an abrupt reduction of the intensity values provided by the ammeter 34 or the drop below a second threshold value. Consequently, the event detection module 36 may be adapted to send to the control module 37 a signal which identifies this draining event, which initiates a timer which measures a predetermined period of time, called the draining time. When the first period of time from the emptying time and the draining time has elapsed, the step 44 is implemented.

The processing unit 25 may be of any known type. According to one embodiment, this processing unit 25 is digital. According to another embodiment, the processing unit 25 is analogue or comprises a combination of digital and analogue means. According to a preferred embodiment, the processing unit 25 comprises at least one microprocessor, at least one random access memory associated with the microprocessor, at least one mass storage memory, in particular for recording the accelerometer signals supplied by the accelerometer 35 and a timer 39.

The event detection and control modules 36, 37 are therefore not necessarily physical, but may be software modules implemented by the microprocessor.

Advantageously, in this embodiment, the accelerometer 35 is preferably welded directly to the printed circuit which carries the microprocessor. This eliminates the problems of sealing by dispensing with any wires passing through walls between the accelerometer 35 and the microprocessor.

Figure 4:
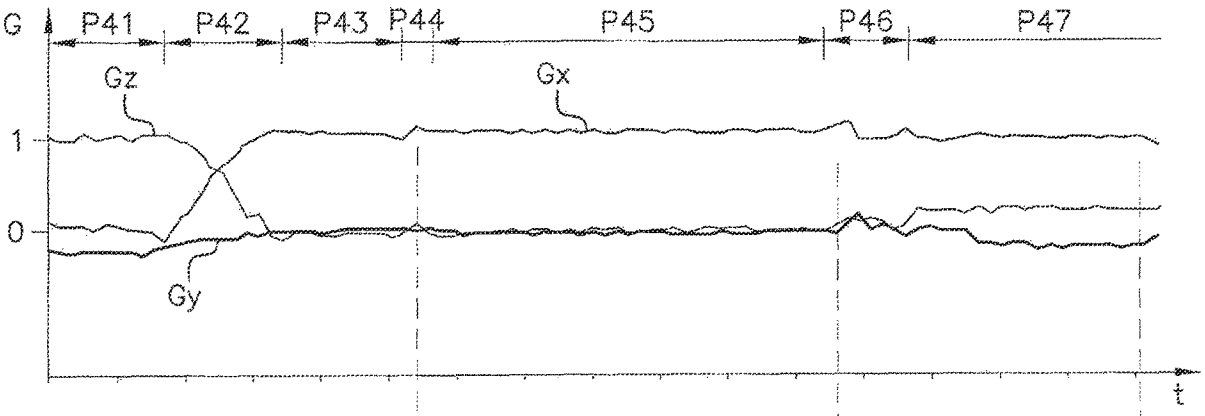
FIG. 4 is a schematic illustration of signals supplied by an accelerometer of a monitoring device in an apparatus according to the invention during a removal event of the apparatus from the water.

FIG. 4 illustrates by way of non-limiting example a possible example of a removal event detected by the detection module 36 on the basis of signals provided by the accelerometer 35. The coordinate values in this Figure are the relationships of the value of the three components Gx, Gy, Gz of the acceleration of the gravitational force along the three orthogonal axes X, Y and Z relative to the module G of the acceleration of the gravitational force in accordance with the time illustrated on the abscissa.

In this Figure, seven separate phases P41 to P47 are identified.

During a first phase P41, it is found that the three components Gx, Gy and Gz of the gravitational acceleration remain substantially constant, Gz and Gy being zero and Gz approximately equal to the gravitational force since the body is on the horizontal base of a swimming pool.

During a second phase P42, the component Gx moves from zero to one and the component Gz from one to zero, which corresponds to the tilting of the body between a horizontal base and a vertical wall.

In a third phase P43, the three components Gx, Gy and Gz of the gravitational acceleration remain substantially constant whilst the body climbs along the vertical wall.

In a fourth phase P44, the two components Gx and Gz vary slightly, which corresponds to the arrival of the body at the water line. The module 36 therefore detects, at the time to, the arrival of the body of the apparatus at the water line.

In a fifth phase P45, it is found that the three components Gx, Gy and Gz of the gravitational acceleration remain substantially constant. Such signals correspond to a substantially immobile situation of the apparatus at the water line.

In a sixth phase P46, a simultaneous variation of the three components Gx, Gy and Gz of the gravitational acceleration may be seen. The simultaneous variation of the three components Gx, Gy and Gz whilst the body is immobile at the water line corresponds to a discharge of water.

The module 36 comprises in particular a state machine according to which the rules applied are dependent on the state of the apparatus. In this manner, when the module detects that the body tilts from a horizontal position to a vertical position, it moves into a "wall climbing" mode in which the values of the three components Gx, Gy, Gz are compared with threshold values specific to this state in order to be able to detect an arrival at the water line (phase P44). In the same manner, after arrival at the detected water line, the state machine moves into a "waiting at the water line" state in which the module 36 compares the values of the components Gx, Gy, Gz to threshold values specific to this state and in particular specific for the detection of a removal from the pool.

As soon as it has been detected that threshold values have been simultaneously exceeded along the three axes, the step 42 of the method is implemented.

During a seventh phase P47, the body is held in an emptying position and the components Gx, Gy and Gz of the gravitational acceleration therefore remain substantially constant.

Figure 5:
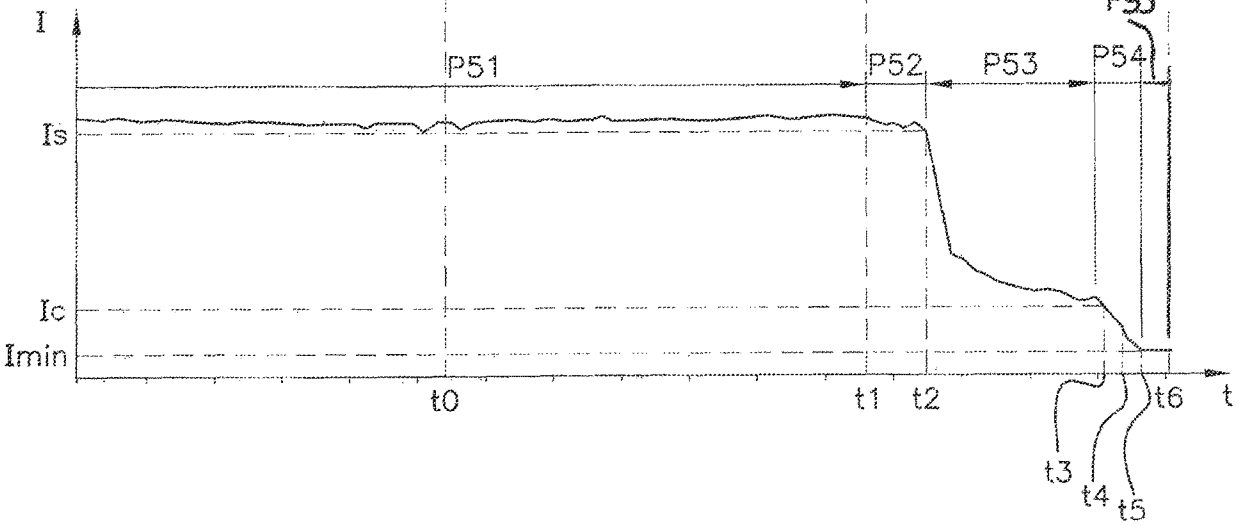
FIG. 5 is a schematic illustration of signals supplied by an ammeter of an electric pumping device in an apparatus according to the invention during a removal event of the apparatus from the water.

FIG. 5 illustrates by way of non-limiting example a possible example of a removal event detected by the detection module 36 on the basis of signals provided by the ammeter 34.

In this Figure, five separate phases P51 to P55 are identified.

In a first phase P51, the intensity is substantially constant at a nominal intensity Io which corresponds to an operation with a hydraulic circuit 23 filled with water, the body being immersed in the pool. This first phase is continued until the time t1.

In a second phase P52, the intensity consumed by the motor 33 of the pumping device varies slightly whilst the body is removed from the water and the hydraulic circuit 23 begins to discharge its water.

Then, in a third phase P53, the intensity decreases abruptly when the body has been completely removed from the water and the detection module 36 detects, at the time t2, the drop below a predetermined threshold value Is recorded in a memory 38. Consequently, the step 42 of the method is implemented, since it is possible to consider that the power supply intensity of the pump falls below the threshold value Is in a characterized manner only when a removal event occurs, and, at the subsequent step 43, the control module 37 initiates the timer 39 for measuring an emptying time.

In the third phase P53, the intensity first drops very rapidly, then decreases more slowly during the emptying of the body.

In a fourth phase P54, from the time t3, the emptying of the body is terminated and the intensity drops again.

In this fourth phase P54, at the time t4, the detection module 36 detects that the intensity has fallen below a predetermined threshold value Ic which is recorded in a memory 38 (or the sudden reduction of the intensity). Consequently, the detection module 36 sends a corresponding signal to the control module 37 which initiates, at the time t4, a timer for measuring a draining time.

At a time t5, the intensity reaches its minimum Imin and, during a fifth phase P55, the pump motor 33 operates at the minimum intensity Imin thereof. The pumping device is completely drained and very little—or no—water remains in the hydraulic circuit. The power supply intensity is low since the air counteracts the rotation of the propeller 21 with only a very low torque, which may bring about rapid damage to the pumping device (motor 33, shaft 26 and propeller 21). For this reason, the draining time (from t4 to t6) must be carefully selected in order to minimize this damage.

After the first of the two times, of emptying or draining, has elapsed, the pump motor 33 is stopped at time t6. If the first of the two times, of emptying or draining, to elapse is the emptying time, this latter corresponds to the period of time (t2-t6), that is, in the embodiment set out, approximately 7 seconds. If the first of the two times, of emptying or draining, to elapse is the draining time, this latter corresponds to the time (t4-t6), that is, in the embodiment set out, approximately 2 seconds.

The draining time is advantageously selected in accordance with the volume of the portion of hydraulic circuit located downstream of the propeller 21, between the propeller and the pump outlet 32. Indeed, the inventors have found that a draining time selected to be lower than 5 seconds allows such a downstream portion of the hydraulic circuit to be emptied better, whilst preventing premature damage to the pumping device.

The invention may have a number of other production variants which are not illustrated.

In this manner, in some embodiments, the hydraulic circuit may have—when the body is in an emptying position—at least one siphon, that is to say, the low point of the circuit is not the pumping outlet. Consequently, the cross-section of the siphon must be sufficiently reduced so as not to bring about draining (that is to say, the movement of at least one section of air downstream of a section of water) of the hydraulic circuit when it is emptied. Furthermore, the power (or total manometric height) of the pumping device must be sufficient to lift the water from the low point of the hydraulic circuit in an emptying position as far as the pumping outlet, in particular as soon as the air front downstream of the water still contained in the hydraulic circuit falls below the level of the pumping outlet (the communicating vessel effect no longer acting on the water still contained in the hydraulic circuit). The height of the pump must therefore be at least equal to and advantageously greater than the height between the low point of the hydraulic circuit in an emptying position and the pumping outlet.

Such embodiments are particularly adapted to hydraulic circuits in which the water which is contained therein is moved by means of gravitational force and/or suction of the pumping device towards the pumping device, without a bubble or an air front becoming propagated in front of a portion of water which is still contained in the hydraulic circuit during the emptying operation. In particular, such a hydraulic circuit, if it has zones of great cross-section, comprises a downstream opening in each zone having a great cross-section which is located at the bottom (in an emptying position) of this zone having a great cross-section.

Furthermore, such embodiments are particularly adapted to hermetic hydraulic circuits, that is to say, whose only openings are the liquid inlets into the body and liquid outlets out of the body, and more specifically to the apparatuses whose hydraulic circuit has only one liquid inlet and one liquid outlet.

An apparatus according to the invention may have a number of other forms and embodiments: cleaning the water of a pool in addition to or in place of cleaning the walls of a pool, hydraulic and/or electric driving, etc.

The invention claimed is:

1. A pool cleaning apparatus comprising:

a. a body (i) comprising an inlet and an outlet and (ii) configured to be immersed in pool water for cleaning of a pool;

b. means for driving the body in the pool;

c. a pump configured to circulate pool water from the inlet to the outlet;

d. means for monitoring whether the body has been removed from the pool and providing a removal signal when the body has been removed from the pool; and e. means for detecting the removal signal and, upon detecting the removal signal, (i) maintaining operation of the pump for a predetermined time so as to allow at least partial active emptying of pool water via the outlet and (ii) ceasing operation of the pump after elapse of the predetermined time.

2. A method of operating a pool cleaning apparatus, comprising:

a. immersing a body of the pool cleaning apparatus in water of a pool;

b. causing operation of a pump of the pool cleaning apparatus so as to circulate water of the pool from an inlet to an outlet of the body; and c. removing the pool cleaning apparatus from the pool, thereby causing (i) a monitoring means of the pool cleaning apparatus to provide a removal signal to a processing unit of the pool cleaning apparatus and (ii) a processing unit to detect the removal signal and, upon detection of the removal signal, (A) maintain operation of the pump for a predetermined time so as to allow at least partial active emptying of pool water via the outlet and (B) cease operation of the pump after elapse of the predetermined time.

3. A method of operating a pool cleaning apparatus according to claim 2 in which the act of maintaining operation of the pump for a predetermined time so as to allow at least partial active emptying of pool water via the outlet comprises pumping air.

4. A pool cleaning apparatus according to claim 1 in which the means for monitoring whether the body has been removed from the pool comprises an accelerometer device attached to the body.

5. A pool cleaning apparatus according to claim 1 in which the pump comprises (a) a motor fixed in the body, (b) a shaft extending from the motor, and (c) a propeller mounted on the shaft.

6. A pool cleaning apparatus according to claim 1 in which the means for driving the body in the pool comprises a plurality of wheels.

7. A pool cleaning apparatus according to claim 1 in which the means for detecting the removal signal comprises a processing unit.

8. A pool cleaning apparatus according to claim 1 further comprising a filter positioned in the body in the circulation of pool water between the inlet and the outlet.

9. A pool cleaning apparatus according to claim 1 in which the body further comprises a handle.

* * * * *